US007450094B2

(12) United States Patent
Kim et al.

(10) Patent No.: US 7,450,094 B2
(45) Date of Patent: Nov. 11, 2008

(54) LIGHT EMITTING DEVICE AND METHOD OF DRIVING THE SAME

(75) Inventors: Ji Hun Kim, Seoul (KR); Sang Dae Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 326 days.

(21) Appl. No.: 11/435,760

(22) Filed: May 18, 2006

(65) Prior Publication Data

US 2007/0095639 A1 May 3, 2007

(30) Foreign Application Priority Data

Sep. 27, 2005 (KR) ..... 10-2005-0089820
Nov. 15, 2005 (KR) ..... 10-2005-0109359
Nov. 16, 2005 (KR) ..... 10-2005-0109527

(51) Int. Cl.
*G09G 3/30* (2006.01)

(52) U.S. Cl. ..... 345/78

(58) Field of Classification Search ..... 345/76–83, 345/204

See application file for complete search history.

(56) References Cited

U.S. PATENT DOCUMENTS 5,946,068 A 8/1999 Lee et al. ..... 349/143
6,710,548 B2 3/2004 Kimura ..... 315/169.3
6,985,124 B1 1/2006 Nogawa ..... 345/55
7,088,052 B2 8/2006 Kimura ..... 315/169.2
2002/0167474 A1 11/2002 Everitt ..... 345/82
2003/0142088 A1 * 7/2003 LeChevalier ..... 345/211
2005/0099367 A1 5/2005 Kang et al. ..... 345/74.1

FOREIGN PATENT DOCUMENTS

EP 1 227 467 A3 7/2002
JP 11-272229 10/1999
JP 2001-109433 4/2001
JP 2004-264667 9/2004
KR 10-2002-0066209 A 8/2002
KR 10-2003-0022804 A 3/2003
KR 10-2005-0032321 A 4/2005

* cited by examiner

*Primary Examiner*—Sumati Lefkowitz
*Assistant Examiner*—Robert E Carter, III
(74) *Attorney, Agent, or Firm*—Morgan Lewis & Bockius LLP

(57) ABSTRACT

The present invention relates to a light emitting device where currents passing through scan lines have the same values. The light emitting device includes data lines, scan lines, pixels, one or more dummy data line and a cross-talk preventing circuit. The data lines are disposed in a first direction, and the scan lines are disposed in a second direction. The pixels are formed in cross areas of the data lines and the scan lines. The dummy data line is disposed in the first direction. The cross-talk preventing circuit provides a compensating current to scan line related to luminescence of the scan lines through the dummy data line so that total sum of current passing through the scan line has a desired value. In the light emitting device, currents passing through scan lines have the same values, and so a cross-talk phenomenon is not occurred to a panel.

20 Claims, 12 Drawing Sheets

LIGHT EMITTING DEVICE AND METHOD OF DRIVING THE SAME

BACKGROUND OF THE INVENTION

1. Field of the Invention

The present invention relates to a light emitting device and a method of driving the same. More particularly, the present invention relates to a light emitting device where currents passing through scan lines have the same values and a method of driving the same.

2. Description of the Related Art

A light emitting device emits a light having a certain wavelength, and especially an organic electroluminescent device is self light emitting device.

FIG. 1A is a block diagram illustrating a common organic electroluminescent device. FIG. 1B and FIG. 1C are views illustrating a method of driving the organic electroluminescent device of FIG. 1A.

In FIG. 1A, the organic electroluminescent device includes a panel 100, a controller 102, a first scan driving circuit 104, a second scan driving circuit 106 and a data driving circuit 108.

The panel 100 includes a plurality of pixels E11 to E34 formed in cross areas of data lines D1 to D3 and scan lines S1 to S4.

The controller 102 controls the scan driving circuits 104 and 106 and the data driving circuit 108 by using display data inputted from an outside apparatus (not shown).

The first scan driving circuit 104 is coupled to some of the scan lines S1 to S4, e.g. S1 and S3, and transmits first scan signals to the some S1 and S3.

The second scan driving circuit 106 is coupled to the other scan lines S2 and S4, and transmits second scan signals to the other scan lines S2 and S4.

The data driving circuit 108 provides data currents corresponding to the display data to the data lines D1 to D3 under control of the controller 102, and so the pixels E11 to E34 emit a light.

Hereinafter, a process of driving the organic electroluminescent device will be described in detail with reference to FIG. 1B and FIG. 1C. Here, the pixels E11 to E34 emit a light when corresponding scan line is coupled to a ground, and do not emit a light when corresponding scan line is coupled to a non-luminescent source having the same magnitude as a driving voltage of the organic electroluminescent device, e.g. a voltage V1 corresponding to maximum brightness of pixel. In addition, data current of 0 A is provided to a pixel E11 through a first data line D1, and data currents of 3 A are provided to the other pixels E12 to E34. Additionally, resistor (hereinafter, referred to as "scan line resistor") which each of the scan lines S1 to S4 has is assumed by 10Ω.

In FIG. 1B, the first scan line S1 is coupled to the ground, and the second to fourth scan lines S2 to S4 are coupled to the non-luminescent source. Accordingly, pixels E21 and E31 of the pixels E11 to E31 corresponding to the first scan line S1 emit a light. In this case, a first current passing to the ground through the first scan line S1 is 6A. Hence, each of cathode voltages VC21 and VC31 of the pixels E21 and E31 is 60V (scan line resistor×6 A).

In FIG. 1C, the second scan line S2 is coupled to the ground, and the first, third and fourth scan lines S1, S3 and S4 are coupled to the non-luminescent source. Accordingly, pixels E12 to E32 corresponding to the second scan line S2 emit a light. In this case, a second current passing to the ground through the second scan line S2 is 9A. Hence, each of cathode voltages VC12 to VC32 of the pixels E12 to E32 is 90V (scan line resistor×9 A).

Hereinafter, the pixel E21 corresponding to the first scan line S1 and the pixel E22 corresponding to the second scan line S2 will be compared.

As described above, though data currents having the same magnitude are provided to the pixels E21 and E22, the cathode voltage VC21 and VC22 of the pixels E21 and E22 have different magnitude. Here, the brightness of a pixel is affected by cathode voltage of the pixel, and thus the pixels E21 and E22 emit light having different brightness. Generally, the higher cathode voltage of a pixel has magnitude, the lower the pixel has brightness. Accordingly, the pixel E21 emits a light having higher brightness than the pixel E22.

In case of the pixels E31 to E32, the cathode voltages VC31 and VC32 of the pixels E31 and E32 are different magnitude, and so the pixels E31 and E32 emit light having different brightness. This is referred to as "cross-talk phenomenon".

SUMMARY OF THE INVENTION

It is a feature of the present invention to provide a light emitting device where cross-talk phenomenon is not occurred and a method of driving the same.

A light emitting device includes data lines, scan lines, pixels, one or more dummy data line and a cross-talk preventing circuit. The data lines are disposed in a first direction, and the scan lines are disposed in a second direction different from the first direction. The pixels are formed in cross areas of the data lines and the scan lines. The dummy data line is disposed in the first direction. The cross-talk preventing circuit provides a compensating current to scan line related to luminescence of the scan lines through the dummy data line so that total sum of current passing through the scan line has a desired value.

An organic electroluminescent device according to one embodiment of the present invention includes data lines, at least one dummy data line, scan lines, a plurality of pixels, a plurality of dummy pixels and a cross-talk preventing circuit. The data lines are disposed in a first direction. The dummy data line is disposed in the first direction outside of outmost data line of the data lines. The scan lines are disposed in a second direction different from the first direction. The pixels are formed in cross areas of the data lines and the scan lines. The dummy pixels are formed in cross areas of the dummy data line and the scan lines. The cross-talk preventing circuit provides compensating currents to each of the scan lines through the dummy data lines. Here, currents passing through each of the scan lines have the same values.

A method of driving a light emitting device having a plurality of pixels formed in cross areas of data lines and scan lines according to one embodiment of the present invention includes receiving a plurality of display data; providing data currents corresponding to one display data of the received display data to the data lines; and providing a compensating current to a scan line related to luminescence of the scan lines so that total sum of current passing through the scan line has a desired value.

As described above, in the light emitting device and the method of driving the same, currents passing through scan lines have the same values, and so a cross-talk phenomenon is not occurred to a panel.

BRIEF DESCRIPTION OF THE DRAWINGS

The above and other features and advantages of the present invention will become readily apparent by reference to the following detailed description when considered in conjunction with the accompanying drawings wherein.

DESCRIPTION OF EMBODIMENTS

Hereinafter, the preferred embodiments of the present invention will be explained in more detail with reference to the accompanying drawings.

Figure 1A:
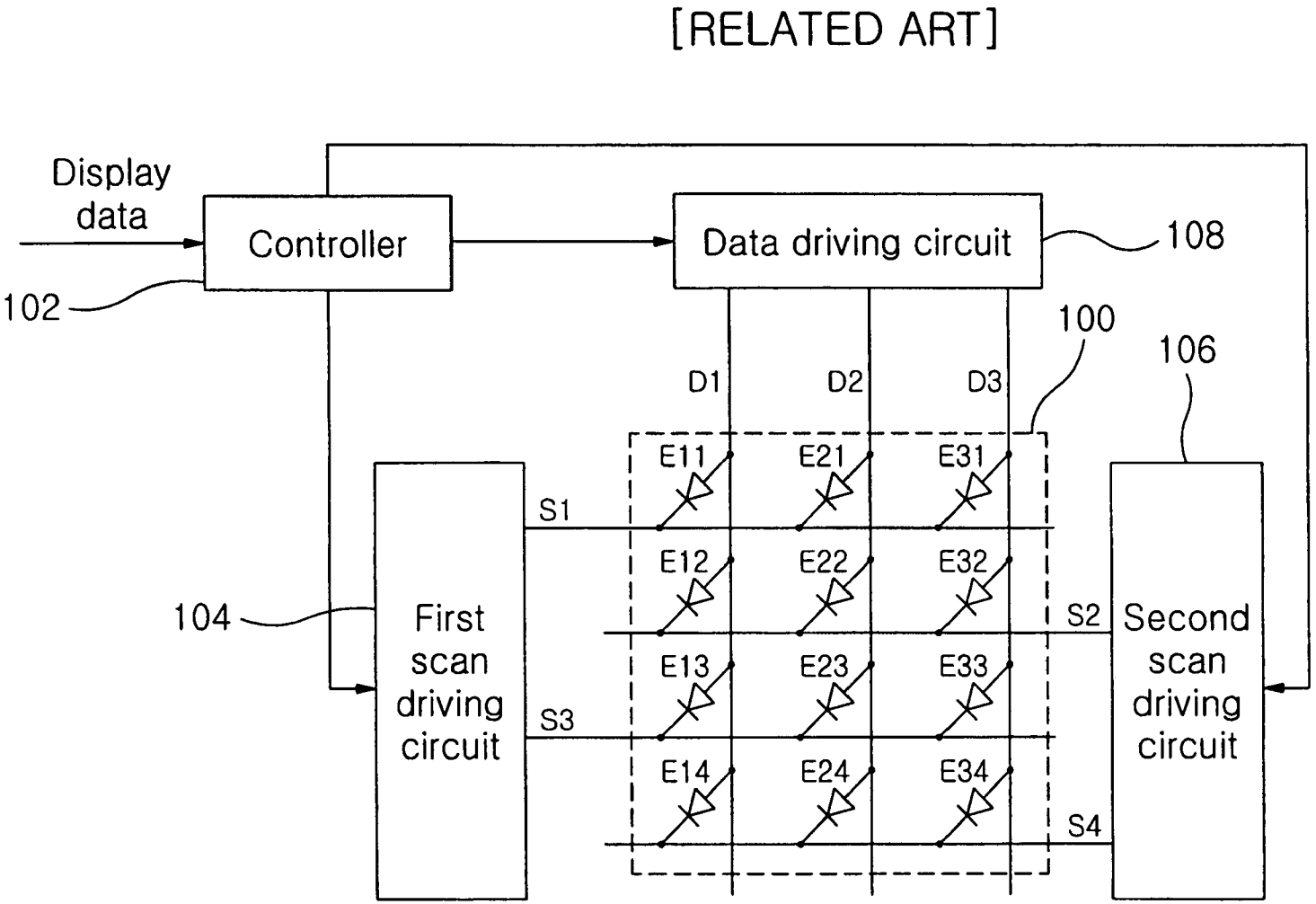
FIG. 1A is a block diagram illustrating a common organic electroluminescent device.
Figure 1B:
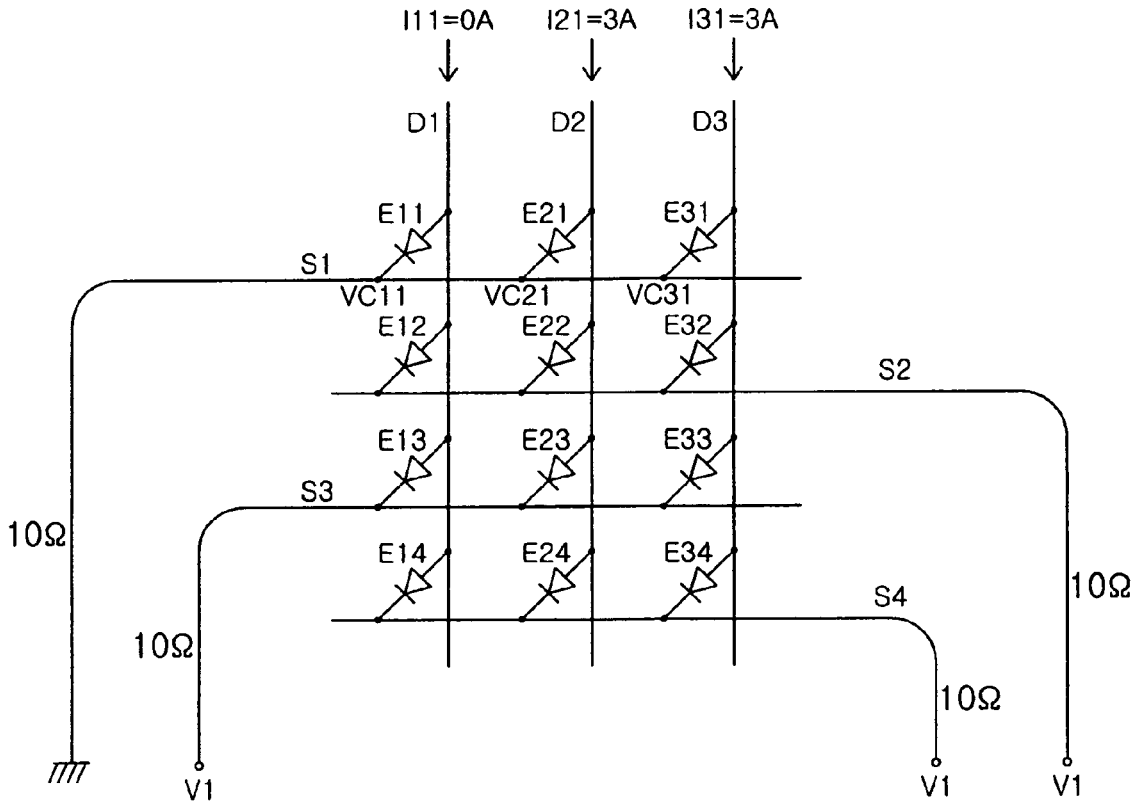
FIG. 1B [RELATED ART]
FIG. 1B and FIG. 1C are views illustrating a method of driving the organic electroluminescent device of FIG. 1A.
Figure 1C:
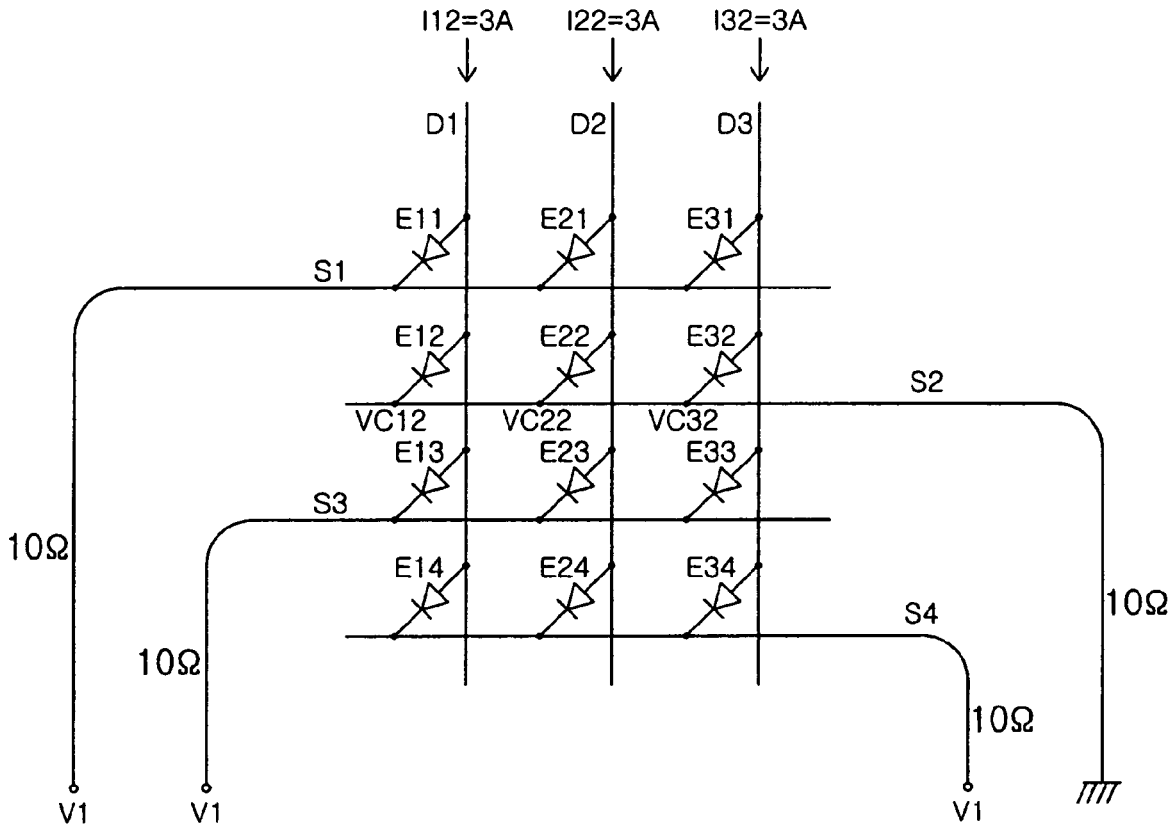
FIG. 1C [RELATED ART]
Figure 2A:
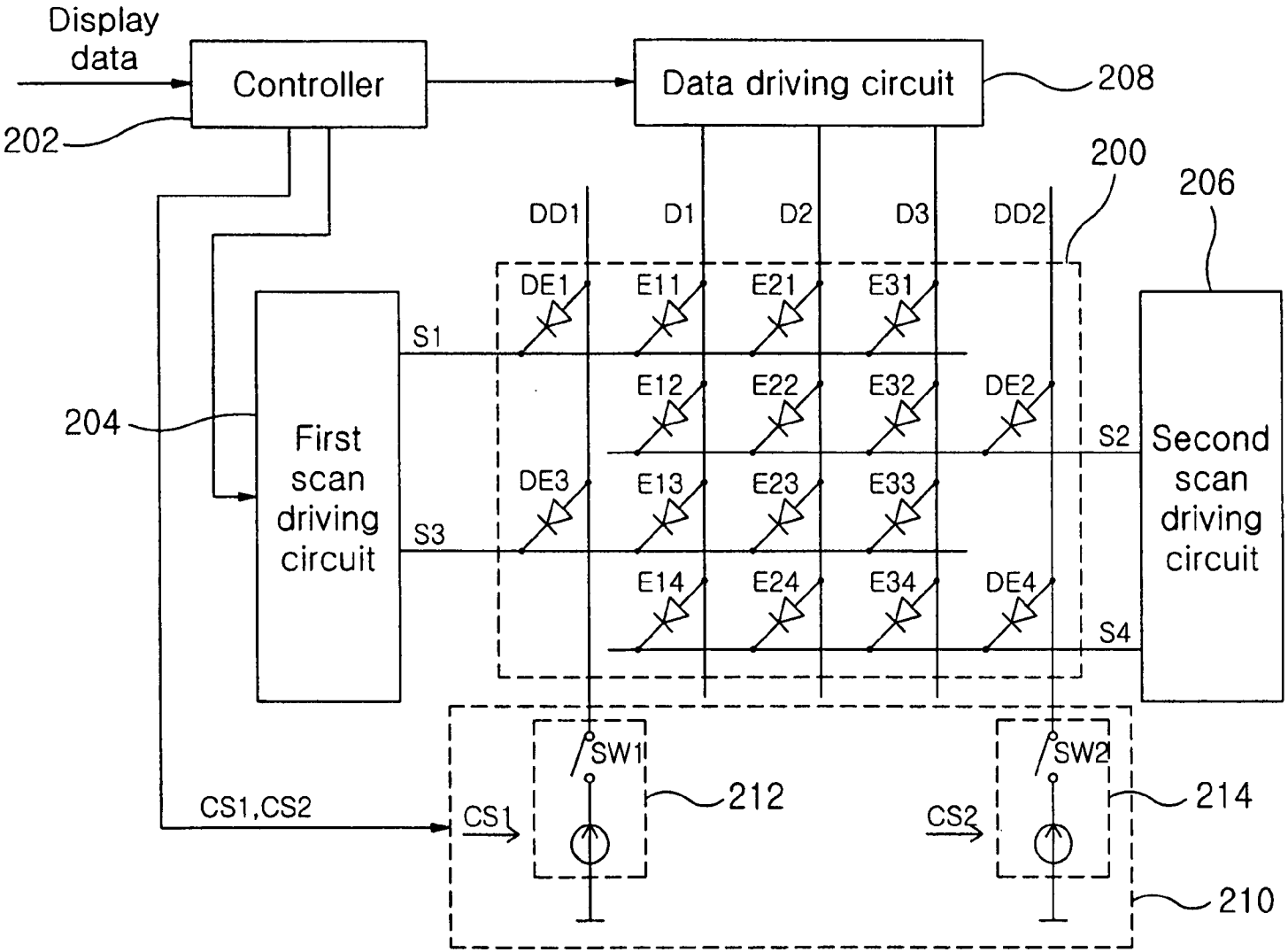
FIG. 2A is a block diagram illustrating a light emitting device according to a first embodiment of the present invention.
Figure 2B:
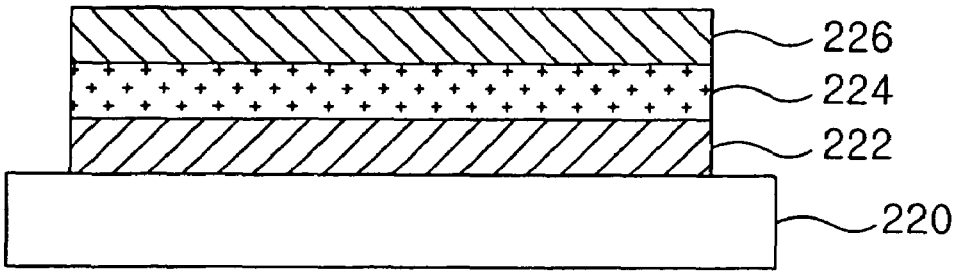
FIG. 2B is a sectional view illustrating one pixel in FIG. 2A.
Figure 2C:
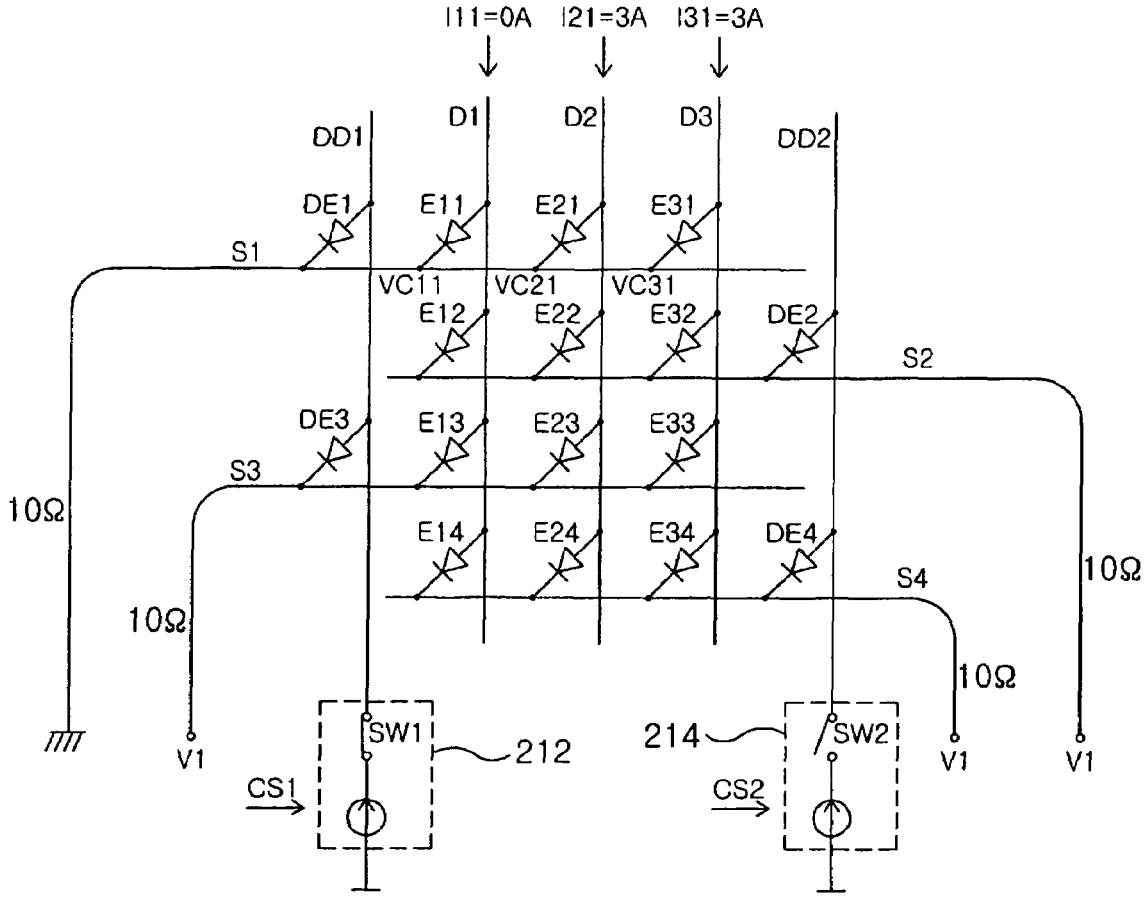
FIG. 2C and FIG. 2D are views illustrating a process of driving the light emitting device of FIG. 2A.
Figure 2D:
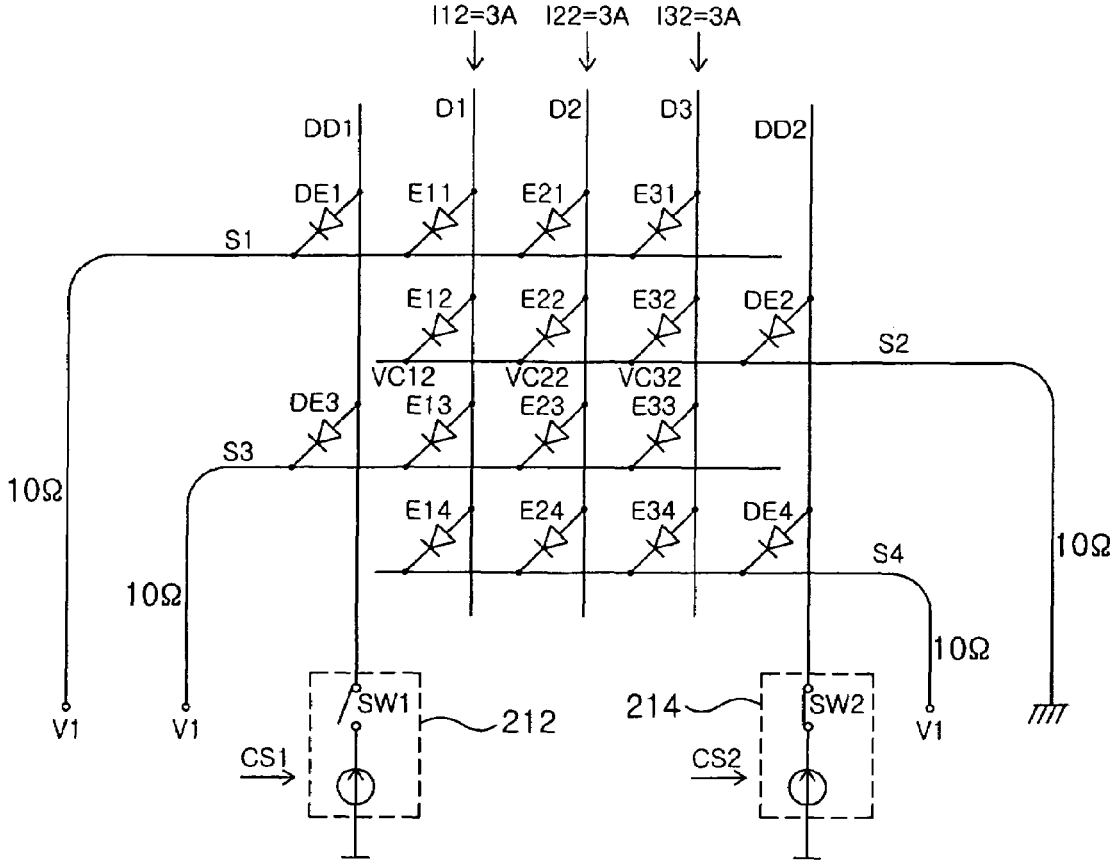

FIG. 2A is a block diagram illustrating a light emitting device according to a first embodiment of the present invention. FIG. 2B is a sectional view illustrating one pixel in FIG. 2A. FIG. 2C and FIG. 2D are views illustrating a process of driving the light emitting device of FIG. 2A.

In FIG. 2A, the light emitting device of the present invention includes a panel 200, a controller 202, a first scan driving circuit 204, a second scan driving circuit 206, a data driving circuit 208 and a cross-talk preventing circuit 210.

The light emitting device according to one embodiment of the present invention includes an organic electroluminescent device, a plasma display panel, a liquid crystal display, and others. Hereinafter, the organic electroluminescent device will be described as an example of the light emitting device for convenience of the description.

The panel 200 includes a plurality of pixels E11 to E34 formed in cross areas of data lines D1 to D3 and scan lines S1 to S4 and dummy pixels DE1 to DE4 formed in cross areas of dummy data lines DD1 and DD2 and the scan lines S1 to S4.

In case that the light emitting device is organic electroluminescent device, each of the pixels E11 to E34 has an anode electrode layer 222 as transparent electrode, an organic layer 224 made up of organic substance and a cathode electrode layer 226 made up of metal such as aluminum Al, etc. formed in sequence on a substrate 220. Here, the organic layer 224 includes an emitting layer.

In case that a positive voltage is provided to the anode electrode layer 222 and a negative voltage is provided to the cathode electrode layer 226, the organic layer 224 emits a light having a certain wavelength.

The controller 202 controls the scan driving circuits 204 and 206, the data driving circuit 208 and the cross-talk preventing circuit 210 by using display data, e.g. RGB data inputted from an outside apparatus (not shown). Here, the controller 202 may store the display data.

The first scan driving circuit 204 is coupled to some of the scan lines S1 to S4, e.g. S1 and S3, and transmits first scan signals to the some S1 and S3.

The second scan driving circuit 206 is coupled to the other scan lines S2 and S4, and transmits second scan lines to the other scan lines S2 and S4.

The data driving circuit 208 provides data currents corresponding to the display data to the data lines D1 to D3 under control of the controller 202, and so the pixels E11 to E34 emit light. Here, the data currents are synchronized with the scan signals.

The cross-talk preventing circuit 210 includes a first current providing circuit 212 and a second current providing circuit 214.

The first current providing circuit 212 includes a first current source, and provides a first current outputted from the first current source to the scan lines S1 and S3 in accordance with a first controlling signal CS1 transmitted from the controller 202.

The second current providing circuit 214 includes a second current source, and provides a second current outputted from the second current source to the other scan lines S2 and S4 in accordance with a second controlling signal CS2 transmitted from the controller 202.

On the other hand, the current providing circuits 212 and 214 provide the first and second currents to the scan lines S1 to S4 so that current passing through the scan lines S1 to S4 have the same values.

Hereinafter, a process of driving the organic electroluminescent device will be described in detail with reference to FIG. 2C and FIG. 2D. Here, the pixels E11 to E34 emit a light when corresponding scan line is coupled to a luminescent source, preferably ground, and do not emit a light when corresponding scan line is coupled to a non-luminescent source having the same magnitude as a driving voltage of the light emitting device, e.g. a voltage V2 corresponding to maximum brightness of pixel. In addition, data current of 0 A is provided to a pixel E11 through a first data line D1, and data currents of 3 A are provided to the other pixels E12 to E34. Additionally, resistor (hereinafter, referred to as "scan line resistor) which each of the scan lines S1 to S4 has is assumed by 10Ω. Hereinafter, the luminescent source is assumed to be the ground.

Firstly, the controller 202 analyzes first display data inputted from the outside apparatus, and so detects that current passing through the first scan line S1 is 6A. Then, the controller 202 transmits a first controlling signal CS1 to the first current providing circuit 212.

Subsequently, the first scan line S1 is coupled to the ground, and the second to fourth scan lines S2 to S4 are coupled to the non-luminescent source.

Then, data currents of 3 A pass to the ground through the second and third data lines D2 and D3 and the pixels E21 and E31, and so the pixels E21 and E31 emit light. In this case, the first current providing circuit 212 provides dummy data current of 4 A to the first scan line S1 through the first dummy data line DD1 and the first dummy pixel DE1 after turning-on a switch SW1 in accordance with the first controlling signal CS1. Hence, current of 10 A passes to the ground through the first scan line S1. Accordingly, cathode voltages VC11 to VC31 of the pixels E11 to E31 corresponding to the first scan line S1 are 100V (10 A×10Ω).

Subsequently, the controller 202 analyzes second display data inputted from the outside apparatus, and so detects that current passing through the second scan line S2 is 9A. Then, the controller 202 transmits a second controlling signal CS2 to the second current providing circuit 214. Here, the second display data is inputted to the controller 202 after the first display data is inputted to the controller 202.

Subsequently, the second scan line S2 is coupled to the ground, and the first, third and fourth scan lines S1, S3 and S4 are coupled to the non-luminescent source.

Then, data currents of 3 A pass to the ground through the first to third data lines D1 to D3 and the pixels E12 to E32, and so the pixels E12 to E32 emit light. In this case, the second current providing circuit 214 provides dummy data current of 1 A to the second scan line S2 through the second dummy data line DD2 and the second dummy pixel DE2 after turning-on a switch SW2 in accordance with the second controlling signal CS2. Hence, current of 10 A passes to the ground through the second scan line S2. Accordingly, cathode voltages VC12 to VC32 of the pixels E12 to E32 corresponding to the second scan line S2 are 100V (10 A×10Ω).

Cathode voltages VC13 to E34 of the pixels E13 to E34 corresponding to the third and fourth scan lines S3 and S4 calculated by using the above method are 100V (10 A×10Ω).

In brief, in the light emitting device of the present invention, the cathode voltages of the pixels E11 to E34 have the same magnitude irrespective of the magnitude of the data currents provided to the data lines D1 to D3. Therefore, in the light emitting device of the present invention unlike the light emitting device described in Related Art, the pixels have the same brightness when data currents having the same magnitude are provided to the pixels. Accordingly, in the light emitting device of the present invention unlike the light emitting device described in Related Art, a cross-talk phenomenon is not occurred.

Figure 3:
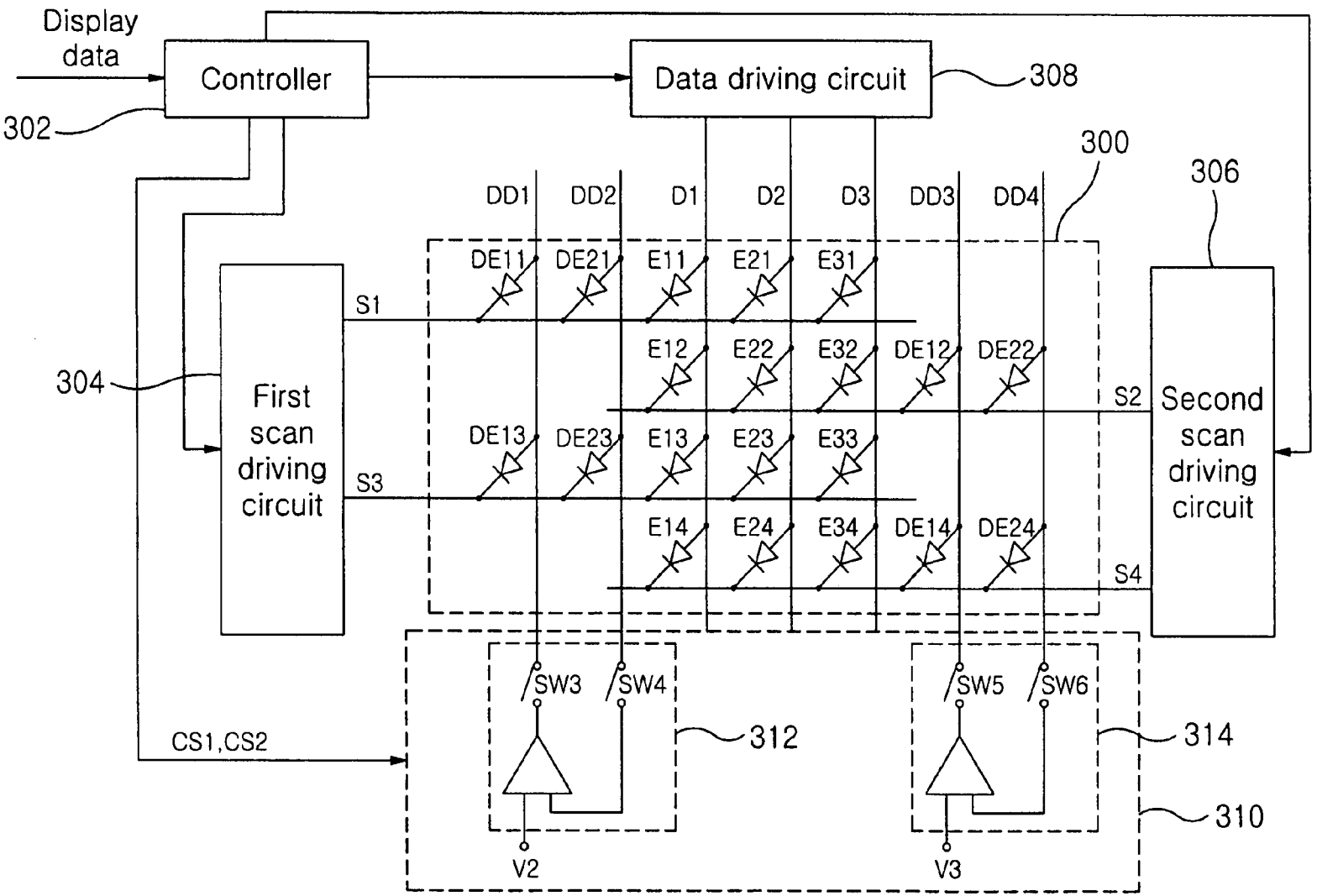
FIG. 3 is a block diagram illustrating a light emitting device according to a second embodiment of the present invention.

FIG. 3 is a block diagram illustrating a light emitting device according to a second embodiment of the present invention.

In FIG. 3, the light emitting device of the present invention includes a panel 300, a controller 302, a first scan driving circuit 304, a second scan driving circuit 306, a data driving circuit 308 and a cross-talk preventing circuit 310.

Since the elements of the present invention except the cross-talk preventing circuit 310 are the same in the first embodiment, any further description concerning to the same elements will be omitted.

The cross-talk preventing circuit 310 includes a first current providing circuit 312 and a second current providing circuit 314.

The first current providing circuit 312 provides a certain current to some of the scan lines S1 to S4. e.g. S1 and S3 using a first OP amplifier included therein so that the currents passing through the scan lines S1 to S4 have the same values.

Hereinafter, the first current providing circuit 312 will be described through the first scan line S1. Here, value of current passing through each of the scan lines S1 to S4 by using the first OP amplifier is assumed by 10 A. In addition, the cathode voltage of a dummy pixel DE11 is assumed by 100V.

An input voltage V2 corresponding to the value of the current is inputted to one terminal of input terminals of the first OP amplifier. Additionally, the other terminal of the input terminals is coupled to a dummy pixel DE21, and so the first current providing circuit 312 detects cathode voltage of the dummy pixel DE21. Here, in case that the detected cathode voltage is different from the input voltage V2, the first OP amplifier provides a certain current to the first scan line S1 through a first dummy data line DD1 and the dummy pixel DE11 so that the cathode voltage of the dummy pixel DE11 is 100V. Whereas, in case that the detected cathode voltage is identical to the input voltage V2, the first OP amplifier does not output any current.

The second current providing circuit 314 provides a certain current to the other scan lines by using a second OP amplifier included therein so that the currents passing through the scan lines S1 to S4 have the same values.

Figure 4:
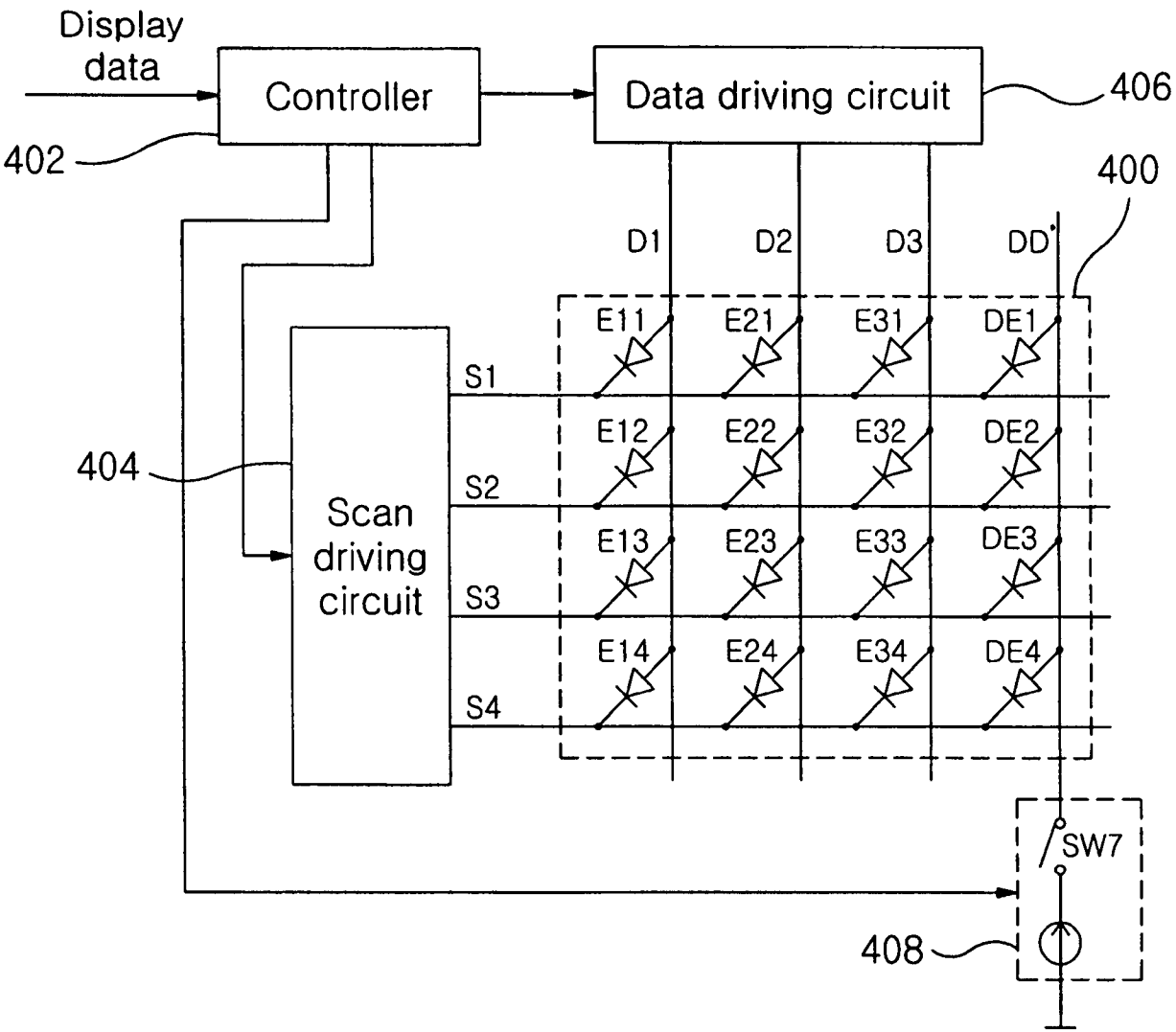
FIG. 4 is a view illustrating a light emitting device according to a third embodiment of the present invention.

FIG. 4 is a view illustrating a light emitting device according to a third embodiment of the present invention.

In FIG. 4, the light emitting device of the present invention includes a panel 400, a controller 402, a scan driving circuit 404 and a data driving circuit 406.

Since the elements of the present invention except the scan driving circuit 404 are the same in the first embodiment, any further description concerning to the same elements will be omitted.

The scan driving circuit 404 provides scan signals to scan lines S1 to S4 under control of the controller 402. In other words, the scan lines S1 to S4 are disposed in one direction of the panel 400.

Figure 5A:
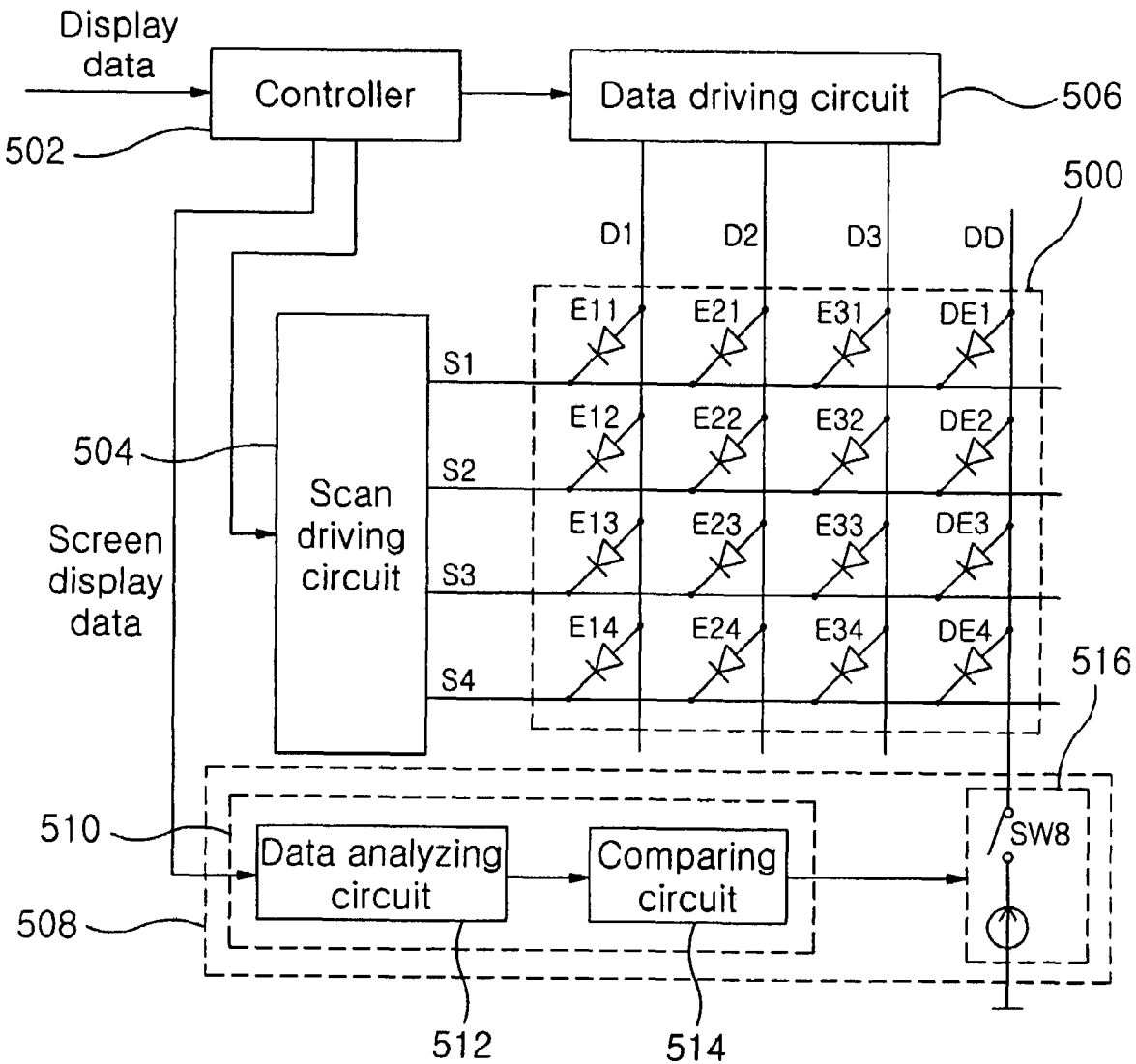
FIG. 5A is a view illustrating a light emitting device according to a fourth embodiment of the present invention.
Figure 5B:
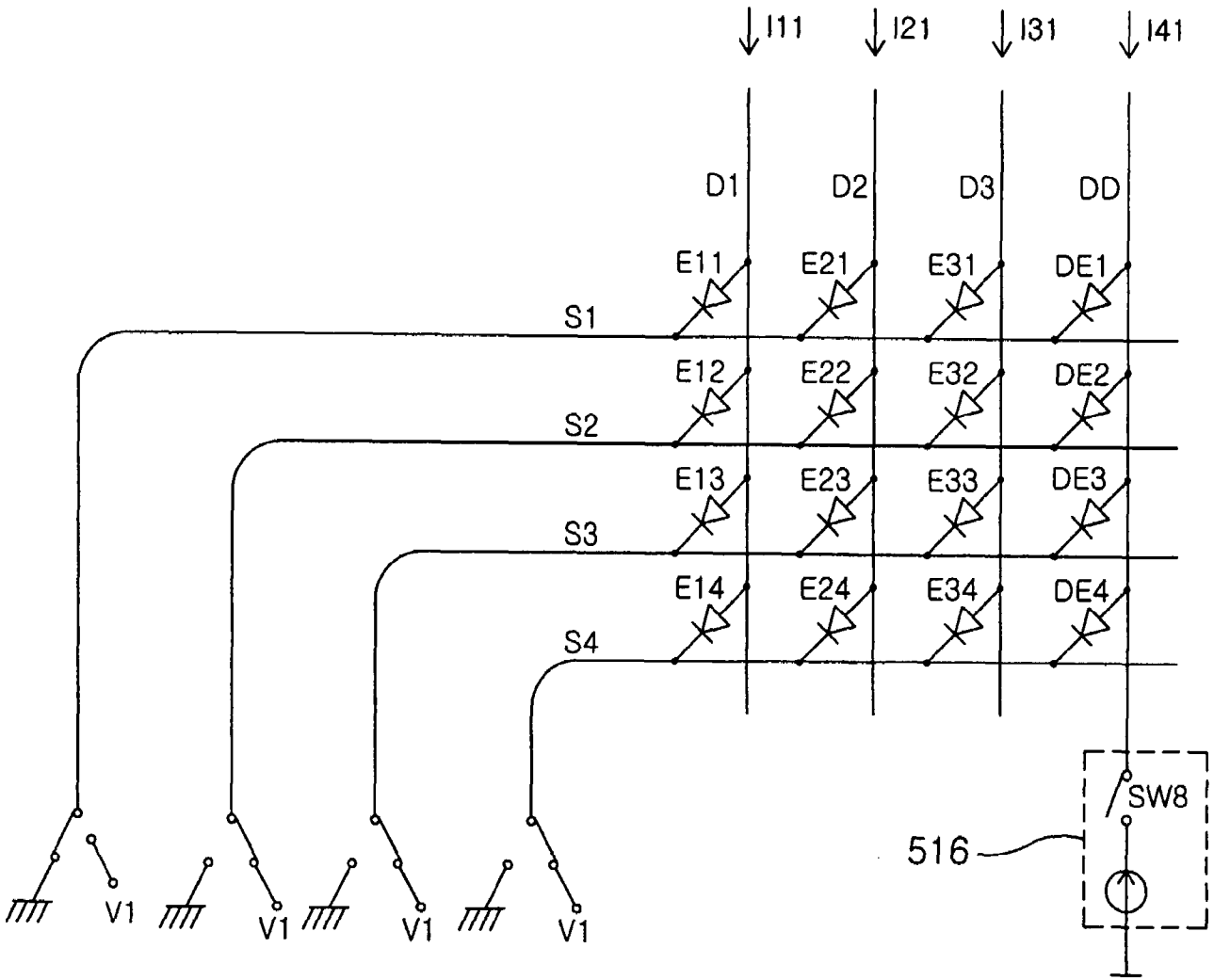
FIG. 5B is a view illustrating a process of driving the light emitting device of FIG. 5A.

FIG. 5A is a view illustrating a light emitting device according to a fourth embodiment of the present invention. FIG. 5B is a view illustrating a process of driving the light emitting device of FIG. 5A.

In FIG. 5A, the light emitting device of the present invention includes a panel 500, a controller 502, a scan driving circuit 504, a data driving circuit 506 and a cross-talk preventing circuit 508.

The panel 500 includes a plurality of pixels E11 to E34 formed in cross areas of data lines D1 to D3 and scan lines S1 to S4 and a plurality of dummy pixels DE1 to DE4 formed in cross areas of a dummy data line DD and the scan lines S1 to S4. Here, the scan lines S1 to S4 are disposed in one direction of the panel 500 as shown in FIG. 5A.

The controller 502 controls the scan driving circuit 504, the data driving circuit 506 and the cross-talk preventing circuit 508 in accordance with display data provided from an outside apparatus (not shown).

The scan driving circuit 504 is coupled to the scan lines S1 to S4, and transmits scan signals to the scan lines S1 to S4.

The data driving circuit 506 provides data currents corresponding to the display data to the data lines D1 to D3 under control of the controller 506.

The cross-talk preventing circuit 508 includes a current circuit 510 and a current providing circuit 516.

The current circuit 510 includes a data analyzing circuit 512 and a comparing circuit 514.

The data analyzing circuit 512 receives a screen display data from the controller 502, and analyzes the received screen display data, thereby detecting display data corresponding to maximum brightness of a plurality of display data included in the screen display data. Here, the screen display data has information concerning to a plurality of display data corresponding to one screen to be displayed on the panel 500. For example, the screen display data includes information concerning to a first to fourth display data inputted in sequence to the controller 502. In addition, the first display data is data related to luminescence of the pixels E11 to E31 corresponding to the first scan line S1, and the second display data is data related to luminescence of the pixels E12 to E32 corresponding to the second scan line S2. Moreover, the third display data is data related to luminescence of the pixels E13 to E33 corresponding to the third scan line S3, and the fourth display data is data related to luminescence of the pixels E14 to E34 corresponding to the fourth scan line S4. In other words, the data analyzing circuit 512 detects display data corresponding to maximum brightness of the first to fourth display data, i.e. display data corresponding to maximum value of currents passing through the scan lines S1 to S4.

The comparing circuit 514 compares sum of data currents corresponding to display data detected by the data analyzing circuit 512, i.e. value of current passing through corresponding scan line with value of current passing through scan line coupled to the ground which is luminescent source, and transmits a controlling signal to the current providing circuit 516 in accordance with the comparison result.

The current providing circuit 516 transmits a certain current to the scan lines S1 to S4 in accordance with the controlling signal transmitted from the comparing circuit 514 so that currents passing through the scan lines S1 to S4 have the same values.

Hereinafter, the cross-talk preventing circuit 508 will be described in detail with reference to FIG. 5B. Here, the pixels E11 to E34 emit a light when corresponding scan line is coupled to a luminescent source, preferably ground, and do not emit a light when corresponding scan line is coupled to a non-luminescent source having the same magnitude as a driving voltage of the light emitting device. Additionally, resistor (hereinafter, referred to as "scan line resistor) which each of the scan lines S1 to S4 has is assumed by 10Ω. Moreover, display data corresponding to maximum brightness of the first to fourth display data is assumed to be the fourth display data.

In FIG. 5B, the first scan line S1 is coupled to the ground which is the luminescent source, the second to the fourth scan lines S2 to S4 are coupled to the non-luminescent source. Accordingly, the pixels E21 and E31 of the pixels E11 to E31 corresponding to the first scan line S1 emit light.

In this case, the current circuit 510 analyzes the screen display data transmitted from the controller 502, and so detects that the fourth display data is data corresponding to maximum brightness of the screen display data. In addition, the current circuit 510 transmits information concerning to the detection result to the comparing circuit 514.

The comparing circuit 514 compares value of current, e.g. 9 A corresponding to the fourth display data passing through the fourth scan line S4 with value of current, e.g. 6 A passing through the first scan line S1 coupled to the ground. Then, the comparing circuit 514 provides a controlling signal to the current providing circuit 516 in accordance with the comparison result.

The current providing circuit 516 provides current of 3 A to the first scan line S1 through the dummy data line DD and the first dummy pixel DE1 in accordance with the controlling signal transmitted from the comparing circuit 514.

The cross-talk preventing circuit 508 provides certain currents to the scan lines S1 to S4 by using the above method so that currents passing through the scan lines S1 to S4 have the same values. Accordingly, the cathode voltages VC11 to VC34 of the pixels E11 to E34 are the same magnitude, and so cross-talk phenomenon is not occurred to the panel 500.

Hereinafter, the light emitting device in the first embodiment and the light emitting device in the fourth embodiment will be compared.

In the light emitting device in the first embodiment, current corresponding to difference of the value of current passing through one scan line and a predetermined value is provided to the scan line. Accordingly, in case that the pixels corresponding to one scan line emit a light having full-white, the predetermined value should be more than value of current passing through the scan line.

Whereas, in the light emitting device in the fourth embodiment, current corresponding to difference of value of current having maximum magnitude of the currents passing through the scan lines S1 to S4 and value of current passing through a scan line coupled to the luminescent source is provided to the scan line. Here, the value of current having maximum magnitude may be smaller than the value of current corresponding to the pixels for emitting light having full-white. Accordingly, power consumption of the light emitting device in the fourth embodiment may be smaller than that of the light emitting device in the first embodiment.

Hereinafter, a process of driving the light emitting device of the present invention will be described in detail.

The controller 502 generates the screen display data using a plurality of display data inputted from the outside apparatus.

Subsequently, the scan driving circuit 504 transmits scan signals to the scan lines S1 to S4.

In another embodiment of the present invention, the step of transmitting the scan signals may be performed prior to the step of generating the screen display data.

Then, the data driving circuit 506 provides data currents corresponding to display data to the data lines D1 to D3 under control of the controller 502. In this case, the current providing circuit 516 provides current corresponding to the screen display data to corresponding scan line.

Figure 6:
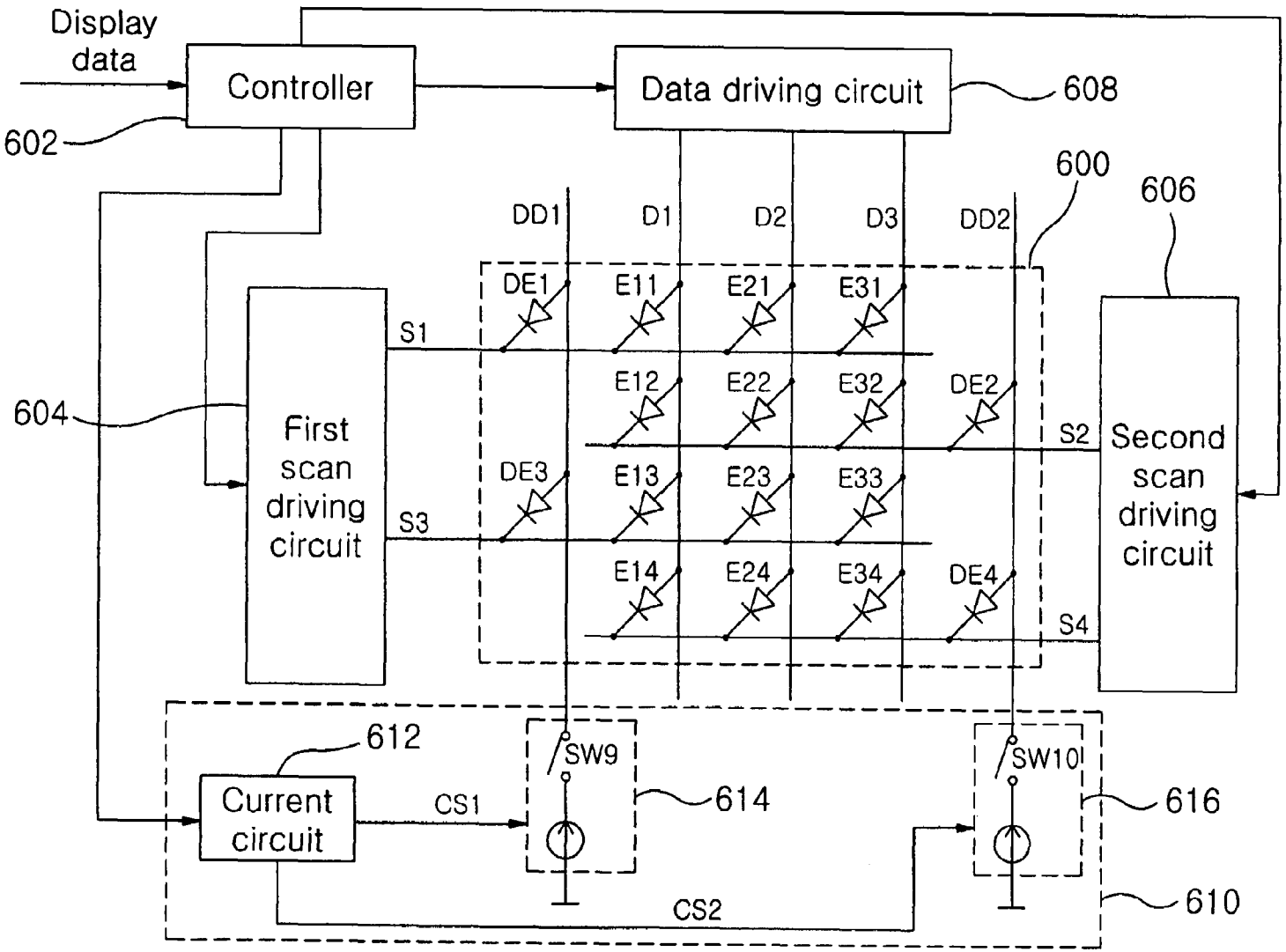
FIG. 6 is a view illustrating a light emitting device according to a fifth embodiment of the present invention.

FIG. 6 is a view illustrating a light emitting device according to a fifth embodiment of the present invention.

In FIG. 6, the light emitting device of the present invention includes a panel 600, a controller 602, a first scan driving circuit 604, a second scan driving circuit 606, a data driving circuit 608 and a cross-talk phenomenon preventing circuit 610.

Since the elements of the present invention except the scan driving circuits 604 and 606 and the cross-talk phenomenon preventing circuit 610 are the same in the fourth embodiment, any further description concerning to the same elements will be omitted.

The first scan driving circuit 604 transmits first scan signals to some of scan lines S1 to S4, e.g. S1 and S3, and the second scan driving circuit 606 transmits second scan signals to the other scan lines S2 and S4.

The cross-talk preventing circuit 610 includes a current circuit 612, a first current providing circuit 614 and a second current providing circuit 616.

The current circuit 612 analyzes screen display data transmitted from the controller 502, and transmits a first controlling signal CS1 and a second controlling signal CS2 to the current providing circuits 614 and 616 in accordance with the analysis.

The first current providing circuit 614 provides a first current to the some S1 and S3 in accordance with the first controlling signal CS1 so that currents passing through the scan lines S1 to S4 have the same values.

The second current providing circuit 616 provides a second current to the other scan lines S2 and S4 in accordance with the second controlling signal CS2 so that currents passing through the scan lines S1 to S4 have the same values.

From the preferred embodiments for the present invention, it is noted that modifications and variations can be made by a person skilled in the art in light of the above teachings. Therefore, it should be understood that changes may be made for a particular embodiment of the present invention within the scope and the spirit of the present invention outlined by the appended claims.

What is claimed is:

1. A light emitting device comprising:

data lines disposed in a first direction;

scan lines disposed in a second direction different from the first direction;

a plurality of pixels formed in cross areas of the data lines and the scan lines;

one or more dummy data lines disposed in the first direction; and a cross-talk preventing circuit configured to provide a compensating current to each scan line related to luminescence of the scan lines through only the one or more dummy data lines so that a total sum of current passing through each scan line during one frame period has a same desired value, and wherein the total sum of current for each scan line equals the compensating current plus all of the data currents passing through that scan line.

2. The light emitting device of claim 1, further comprising:

a plurality of dummy pixels formed in cross areas of the one or more dummy data lines and the scan lines.

3. The light emitting device of claim 2, wherein the one or more dummy data lines are disposed outside of outmost data lines of the data lines.

4. The light emitting device of claim 2, wherein at least one dummy pixel includes the dummy data line, a hole transporting layer, an electron transporting layer and the scan line formed in sequence on a substrate.

5. The light emitting device of claim 2, wherein the cross-talk preventing circuit includes a current providing circuit configured to have current source, and provide the compensating current generated from the current source to the scan line through the dummy data line.

6. The light emitting device of claim 2, wherein the cross-talk preventing circuit includes a current providing circuit configured to have OP amplifier, wherein one of input terminals of the OP amplifier receives input voltage, and other terminal of the input terminals of the OP amplifier is coupled to the scan line related to the luminescence.

7. The light emitting device of claim 2, further comprising:

a controller configured to receive a plurality of display data from an outside apparatus, and generate screen display data corresponding to one screen using the received display data, wherein the cross-talk preventing circuit includes:

a current circuit configured to analyze the screen display data transmitted from the controller to detect value of a first current corresponding to display data having maximum brightness of the screen display data, and compare the value of the first current with value of a second current passing through the scan line related to the luminescence; and a current providing circuit configured to provide the compensating current corresponding to difference of the value of the first current and a value of the second current to the scan line through the dummy data line in accordance with the comparison.

8. The light emitting device of claim 7, wherein the current circuit includes:

a data analyzing circuit configured to analyze the screen display data transmitted from the controller to detect the display data having maximum brightness of the screen display data; and a comparing circuit configured to compare the value of the first current with the value of the second current.

9. The light emitting device of claim 1, wherein the desired value is sum of maximum currents provided to the pixels corresponding to the scan line related to the luminescence.

10. The light emitting device of claim 1, wherein the desired value is current value corresponding to display data having maximum brightness of a plurality of display data corresponding to one screen.

11. The light emitting device of claim 1, further comprising:

a scan driving circuit configured to transmit scan signals to the scan lines;

a data driving circuit configured to provide data currents synchronized with the scan signals to the data lines; and a controller configured to control the cross-talk preventing circuit, the scan driving circuit and the data driving circuit.

12. The light emitting device of claim 1, further comprising:

a first scan driving circuit configured to transmit first scan signals to a part of the scan lines;

a second scan driving circuit configured to transmit second scan signals to the other scan lines;

a data driving circuit configured to provide data currents synchronized with the scan signals to the data lines; and a controller configured to control the cross-talk preventing circuit, the scan driving circuits and the data driving circuit.

13. The light emitting device of claim 1, wherein the light emitting device is electroluminescent device.

14. An organic electroluminescent device comprising:

data lines disposed in a first direction;

at least one dummy data line disposed in the first direction outside of outmost data line of the data lines;

scan lines disposed in a second direction different from the first direction;

a plurality of pixels formed in cross areas of the data lines and the scan lines;

a plurality of dummy pixels formed in cross areas of the at least one dummy data lines and the scan lines; and a cross-talk preventing circuit configured to provide compensating currents to each of the scan lines through only the at least one dummy data lines, wherein the total current passing through each of the scan lines during one frame period have the same values, and wherein the total current for each scan line equals the compensating current plus all of the data currents passing through that scan line.

15. The organic electroluminescent device of claim 14, wherein the cross-talk preventing circuit includes an OP amplifier, and provides the compensating currents to the scan lines using the OP amplifier.

16. A method of driving a light emitting device having a plurality of pixels formed in cross areas of data lines disposed in a first direction and scan lines disposed in a second direction, comprising:

receiving a plurality of display data;

providing data currents corresponding to one display data of the received display data to the data lines; and providing a compensating current to each scan line related to luminescence of the scan lines through only one or more dummy data lines disposed in the first direction so that total sum of current passing through each scan line during one frame period has a same desired value, and wherein the total sum of current for each scan line equals the compensating current plus all of the data currents passing through that scan line.

17. The method of claim 16, wherein the step of providing the compensating current includes:

detecting voltage corresponding to current passing through the scan line related to the luminescence; and providing the compensating current corresponding to difference of the desired value and the detected voltage to the scan line.

18. The method of claim 16, wherein the step of providing the compensating current includes:

generating a screen display data using the received display data;

analyzing the screen display data to detect value of a first current corresponding to display data having maximum brightness of the screen display data;

comparing the value of the first current with a value of a second current passing through the scan line related to the luminescence; and providing the compensating current corresponding to difference of the value of the first current and the value of the second current to the scan line in accordance with the comparison.

19. The method of claim 16, wherein the desired value is sum of maximum currents provided to the pixels corresponding to the scan line related to the luminescence.

20. The method of claim 16, wherein the desired value is current value corresponding to display data having maximum brightness of a plurality of display data corresponding to one screen.

* * * * *